United States Patent [19]

Wyatt

[11] Patent Number: 4,516,739

[45] Date of Patent: May 14, 1985

[54] MAGNETICALLY CONTROLLED WIRE TENSIONING DEVICE

[75] Inventor: Kenneth L. Wyatt, Oklahoma City, Okla.

[73] Assignee: AT&T Technologies, Inc., New York, N.Y.

[21] Appl. No.: 595,135

[22] Filed: Mar. 30, 1984

[51] Int. Cl.[3] ..... B65H 59/16

[52] U.S. Cl. ..... 242/155 M; 310/93

[58] Field of Search ..... 242/155 M, 155 R, 151, 242/147 R, 147 M; 226/195; 310/92, 93

[56] References Cited

U.S. PATENT DOCUMENTS

| | | | |
|---|---|---|---|
| 2,068,820 | 1/1937 | Sarazin et al. | 310/93 |
| 2,591,463 | 4/1952 | Parker | 242/155 M X |
| 2,607,820 | 8/1952 | Judd et al. | 242/155 M X |
| 2,624,527 | 1/1953 | Von Kohorn | 242/155 M |
| 2,632,859 | 3/1953 | Bessiere | 310/93 |
| 2,688,789 | 9/1954 | Duryee | 242/155 M X |
| 3,072,361 | 1/1963 | Fuller | 242/155 M |
| 3,133,746 | 12/1963 | Steen | 242/155 M |
| 3,267,310 | 8/1966 | Ireland | 310/93 X |
| 3,797,775 | 3/1974 | White | 242/155 M |

*Primary Examiner*—Stanley N. Gilreath

*Attorney, Agent, or Firm*—R. P. Miller; M. de Picciotto; H. St. Julian

[57] ABSTRACT

The tension imparted to an advancing strand 11 is regulated by passing the strand about a permanent magnet sheave 13 interposed between a pair of permanent magnet discs 19 and 21. The sheave and discs are axially polarized so that the magnet fields about the sheave are in opposing or repelling relation with the magnetic fields about the discs. By moving (26, 27 and 28) a disc toward or away from the sheave the intensities of the coupled lines of magnetic force are increased or decreased to accordingly vary the magnetic drag placed on the sheave and thus the tension imparted to the advancing strand 11.

18 Claims, 5 Drawing Figures

MAGNETICALLY CONTROLLED WIRE TENSIONING DEVICE

FIELD OF INVENTION

This invention relates to wire tensioning devices controlled by permanent magnets, and more particularly, to the use of three permanent magnets, the first of which is a wire receiving sheave and the other two acting to set up magnetic fields that oppose the magnetic field of the sheave to control the drag on a wire passed around the sheave.

BACKGROUND OF THE INVENTION

Wire passing from a supply source to a utilization device is often required to be tension controlled to prevent overrunning and subsequent tangling and snagging. Numerous wire tensioning and control devices have been developed to overcome these problems. In some instances, magnetic brakes are utilized wherein the effective strength of the magnetic field is altered in response to the operation of a wire tension sensing device.

An example of one such magnetically controlled wire tensioning device is disclosed in U.S. Pat. No. 3,072,361 issued Jan. 8, 1963, to R. E. Fuller. In this patent, wire is passed through an eyelet mounted on a tension response arm. Movement of the arm in response to changes in tension is utilized to move a pair of U-shaped permanent magnets toward or away from a disc constructed of non-magnetic metal. The disc is coupled to a sheave about which the wire is wrapped in one or more turns. Movements of the magnets in response to wire tension changes accordingly increases or decreases the distance that the magnets are positioned with respect to the disc. As the magnets move, the magnetic fields vary in strength and thus accordingly control the drag placed on the disc and the sheave to control the drag tension placed on the wire passing around the sheave.

There is still a need for a simple magnetic wire tension control device using a minimum number of easily manufactured parts. Such a device should be adapted to permit manual or automatic adjustment to control a wire passing from supply source, such as a reel, to a utilization device, such as a winding head. Further, it would be desirable if the wire tension device could be readily expanded to accommodate the control of a number of wires.

SUMMARY OF THE INVENTION

The invention contemplates, among other things, a permanent magnet sheave about which wire or strand is passed together with a pair of adjacent permanent magnets polarized to set up repelling forces that interact with the magnetic field of the sheave to exert a drag on the sheave which is readily adjustable by moving one or both of the pair of magnets with respect to the sheave.

More particularly, in one embodiment of the invention wire from a supply reel is passed around the permanent magnet sheave which is mounted for free rotation on a non-magnetic shaft. Also freely mounted on the shaft are a pair of permanent magnetic discs which are positioned on opposite sides of the sheave. The discs are magnetized to present like magnetic poles to the magnetic poles on the opposite sides of the sheaves. The magnetic fields act to repel and center the sheave between the discs. Axial movements of the discs are restrained by a pair of stops, one or both of which may be adjustably moved along the shaft to accordingly vary the strength of the interaction between the magnetic fields and hence, the drag placed on the sheave and the wire passing around the sheave.

DESCRIPTION OF THE DRAWING

Other features and advantages of the invention will be apparent upon consideration of the following detailed description in conjunction with the drawing wherein.

DETAILED DESCRIPTION

Figure 1:
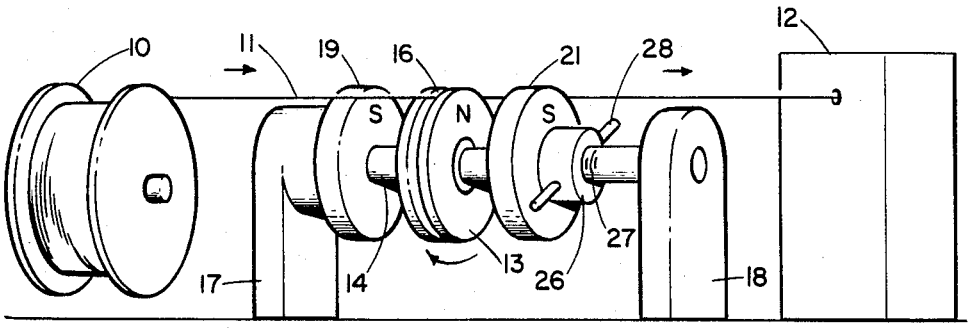
FIG. 1 is a perspective view of a magnetically controlled wire tensioning device embodying the principles of the invention.

Referring to FIG. 1, there is shown a supply reel 10 for a wire 11 that is a being payed off and fed to a utilization device 12, such as a machine including a winding head that may be used to wrap the wire about a coil form. The wire is advanced by the operation of the winding machine so that the wire is withdrawn from the reel and passed as a single wrap around a sheave 13 rotatably mounted on a shaft 14. The sheave is provided with a circumferential groove 16 to accommodate the wire. The shaft is mounted fixedly at opposite ends in stanchions 17 and 18.

Control of the rotation of the sheave is attained by controlling the position of one of a pair of permanent magnet discs 19 and 21. The discs have central bores to permit rotative mounting on the shaft 14 with the sheave 13 interposed therebetween. The sheave 13 is constructed (see FIG. 2) of paramagnetic material and is permanently magnetized in axial fashion to present a north magnetic pole on its right side and a south magnetic pole on its left side. The magnetic discs are axially polarized so that the right side of the disc 19 presents a south magnetic pole to the south magnetic pole on the side of the sheave while the left side of the magnetic disc 21 presents a north magnetic pole to the north magnetic pole on the right hand side of the sheave 13. Distortion of the magnetic fields is minimized by constructing the shaft and the stanchions of non-magnetizable material such a stainless steel.

With the disclosed polarization system, both magnetic discs 19 and 21 act to repel and hence center the sheave 13 between the discs. Leftward movement of the disc 19 is restrained by engagement with the side of the stanchion 17 and in like manner the rightward movement of the disc 21 is restrained by engagement with the side of a stainless steel adjustable nut 26. The nut 26 is threadably mounted on a screw section 27 of the shaft 14. The repelling magnetic fields not only act to center the sheave between the discs but also act to prevent rotative movement of the sheave relative to the discs. It will be noted that the discs 19 and 21 are frictionally restrained from rotative movement because the discs are forced against the side of the stanchion 17 and the end of the nut 26.

Figure 2:
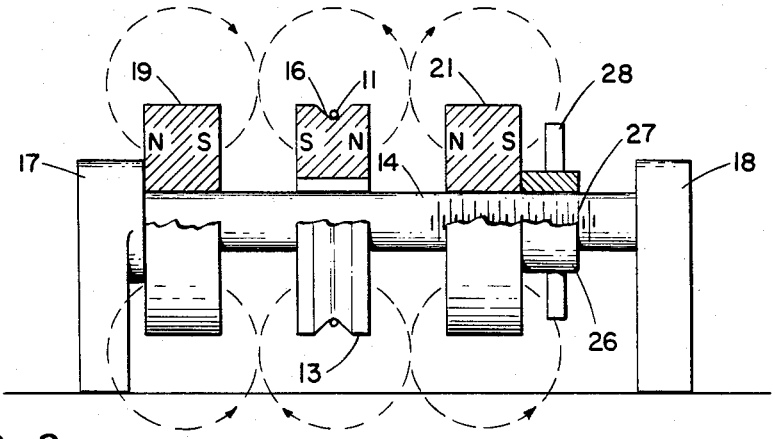
FIG. 2 is a partially sectional side view of the device shown in FIG. 1 illustrating an arrangement of a permanent magnetic sheave and a pair of permanent magnetic discs that may be shifted to vary the drag on the magnetic sheave.

The directions of the magnetic fields are graphically illustrated in FIG. 2. It will be appreciated that the lines of magnetic flux in the fields set up between respective magnets tend toward stabilization and oppose movement of one field relative to the other. The advancing wire 11 wrapped about the sheave 13 acts to rotate the sheave and hence its magnetic field. The rotation of the magnetic field set up about the sheave is opposed by the coupled magnetic fields established about the discs. As the magnetic lines of force emanating from the rotating sheave cross the stationary magnetic lines of force of the fields set up between discs, there is a drag set up which is imparted to resist rotation of the sheave and the advance of the wire passing around the sheave.

The strength of the interacting magnetic lines of force may be varied by moving the disc 21 toward or away from the sheave 13. The nut 26 is provided with a handle 28 that may be turned to move the nut along the threaded section of the shaft. When the nut 26 is moved leftward, the intensity of the interacting magnetic fields increases with the consequent increase in repelling forces and an increase on the drag placed on the sheave. When the magnetic disc 21 is moved away from the sheave 13, there is a decrease in the magnetic lines of force interacting with the magnetic field of the sheave and as a consequence, there is a decrease in the intensity of the magnetic flux lines between the sheave and the disc and accordingly, there is a decrease in the drag placed on the sheave. Simultaneously with the movement of the sheave 13, there are increases or decreases in the repelling magnetic fields between the disc 19 and the sheave 13 so that the drag effect on the sheave is increased or decreased. It will be noted that the movement of the disc 21 is accompanied by a movement of the sheave 13 which is one-half the distance of the movement of the disc 21 so that the sheave is always centered between the discs 19 and 21.

Figure 3:
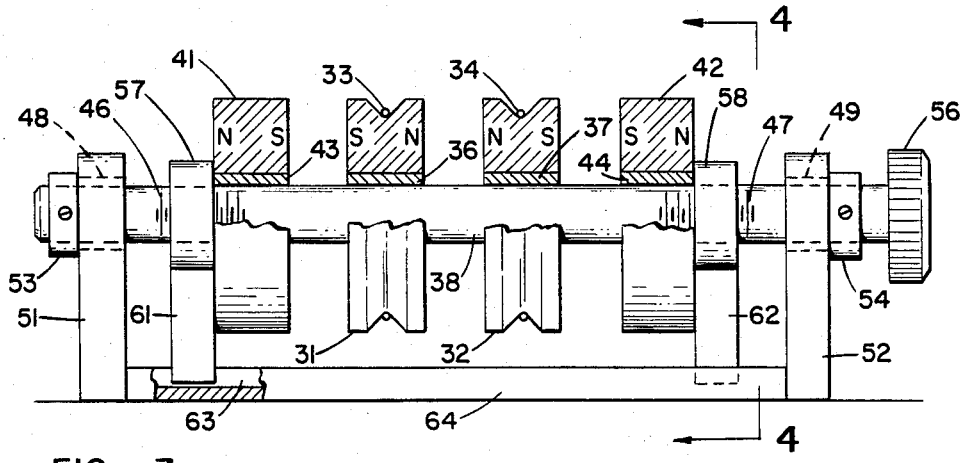
FIG. 3 is a partially sectional side view of another embodiment of the invention wherein a pair of permanent magnetic discs may be shifted to control a plurality of permanent magnetic sheaves.
Figure 4:
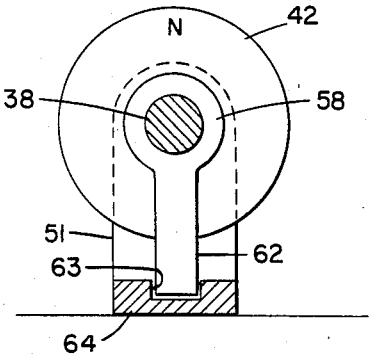
FIG. 4 is a section view taken along line 4—4 of FIG. 3 depicting guide facilities for restraining rotative movement of one of the permanent magnetic controlled discs.

Attention is directed to FIG. 3 for an understanding of another embodiment of the invention. In this instance, a pair of wire receiving and tensioning sheaves 31 and 32 are simultaneously controlled to adjust the drag placed on a number of advancing wires 33 and 34 passing around the sheaves. Again, the sheaves are constructed of magnetizable material and are permanently magnetized in accordance with the showing of the polarization in FIG. 3. The sheaves 31 and 32 are bored to receive circular bearings 36 and 37 that are journaled on a smooth shank portion of a shaft 38. A pair of permanent magnetic discs 41 and 42 are provided with threaded inserts 43 and 44 that are screwed onto threaded sections 46 and 47 of the shaft 38. Non-threaded end sections of the shaft 38 are mounted to extend through sleeve bearings 48 and 49 mounted in uprights 51 and 52. A pair of collars 53 and 54 are pinned to the shaft 38 and positioned adjacent to the uprights 51 and 52 to prevent axial movement of the shaft while permitting rotative movement. A nob 56 is secured to the right end of the shaft 38 to allow an attending operator to rotate the shaft and move the discs 41 and 42 toward and away from the sheaves 31 and 32. The threaded sections 46 and 47 are of opposite hand; thus, the discs 41 and 42 move in unison toward and away from each other. Secured to the outer side of the discs 41 and 42 are a pair of collars 57 and 58 formed with or having attached thereto depending guide arms 61 and 62 (see also FIG. 4). The lower ends of the guide arms 61 and 62 ride within a channel 63 formed in a stationary bar 64. This arrangement prevents rotation of the discs 41 and 42 while permitting axial movements along the shaft 38.

In use of this embodiment, the pair of wires 33 and 34 emanating from a supply source are run about the sheaves 31 and 32 and directed to a take-up device such as a winding machine. The repelling magnetic fields act to space the sheaves 31 and 32 along the shaft 38 and also act to space the sheaves from the magnetic discs 41 and 42. The magnetic lines of force set up between opposing magnetic fields interact to oppose rotative movement of the sheaves, and hence, place a drag on the advancing wires 33 and 34 acting to rotate the sheaves. This magnetic drag may be adjusted by moving the discs 41 and 42 toward or away from the magnetic sheaves. By turning the nob 56 to move the discs 41 and 42 from the sheaves, the coupled magnetic flux density decreases and the discs are subject to a decrease in drag and the wires may be payed from the sheaves with decreased tension. Turning the nob in the opposite direction to move the discs 41 and 42 toward the sheaves results in an increase in the intensity of the coupled interacting magnetic fields thus further restraining the sheaves 31 and 32 from free rotation, thereby increasing the tension imparted to the strands 33 and 34.

If one of the magnetic sheaves shown in FIG. 3 is removed, then the adjustments of the discs 41 and 42 will vary the magnetic drag imparted to the single sheave while maintaining the sheave in the same center location.

Figure 5:
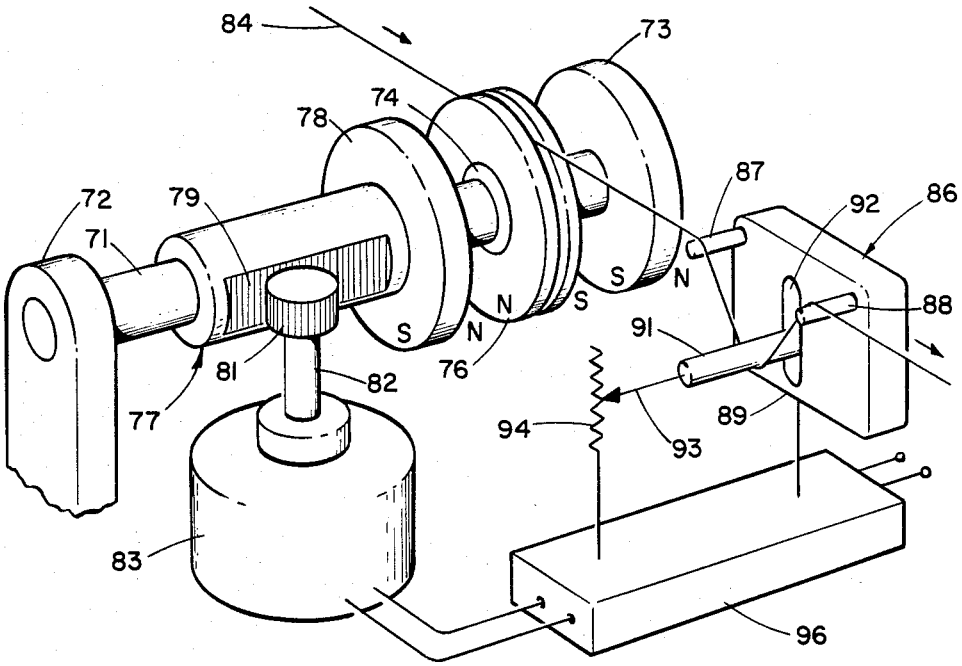
FIG. 5 is a perspective view of a further embodiment of the invention showing automatic control means for adjusting the position of the drag magnets in accordance with the tension sensed in a wire running to a utilization device.

Referring to FIG. 5, for an understanding of a third embodiment of the invention, there is shown a stud shaft 71 mounted in and projecting form an upright boss 72. Fixed to one end of the shaft is a first magnet disc 73 that is axially magnetized to present north-south poles as shown in the drawing. Freely mounted on the shaft 71 by a circular bearing 74 is a permanent magnet sheave 76. Slidably mounted on the shaft 71 is linear bearing 77 to which is secured a second permanent magnet disc 78 that is axially polarized to present north-south poles as depicted in the drawing. A casing of the linear bearing 77 provides a support for a rack 79 meshing with a drive pinion 81. Pinion 81 is coupled by a shaft 82 to a commercial stepping motor 83. A strand 84 wrapped with a single turn about the sheath 76 is advanced through a tension sensing arrangement 86 comprising a pair of fixed pins 87 and 88 mounted on a frame plate 89 and a spring loaded pin 91 adapted to ride vertically in a guide slot 92 formed in the frame plate 89.

As the tension in the strand 84 varies, the pin 91 is raised or lowered to move an attached contactor arm 93 relative to a resistor 94 of a potentiometer. The resistor 94 is included in a circuit running to a commercial controller or computer 96. Variations in current due to the movement of the arm 91 and the contactor 93 are analyzed by the controller to generate a pulse stream to step the motor 83 in either a clockwise or counterclockwise direction. In turn, the motor rotates the shaft 82 and the pinion 81 to slide the rack 79 and the linear bearing 77 relative to the shaft 71. Sliding movement of the linear bearing causes the second magnetic disc 78 to move toward or away from the magnetic sheave 76. This movement of the disc 78 accordingly increases or decreases the coupled intensity of the magnetic fields between the disc 78 and the sheave 76. The movement of the sheave 76 also results in a change in the intensity of the magnetic fields coupling the sheave 76 and disc 73.

More particularly, as the disc 78 moves away from the sheave 76, the decreasing strength of the coupled magnetic fields allows the sheave 76 to rotate more freely and thus decrease the drag or tension imparted to the strand 84. In the situation where the tension sensing device 86 detects a decrease in tension in the strand 84, signals are imparted to the motor 83 to effectuate a movement of the disc 78 toward the sheave 76. This movement results in an increase in the number of coupled lines of magnetic force thereby exerting an increased drag effect on the sheave 76 to accordingly increase the tension imparted to the strand 84 passing around the sheave.

Though the various embodiments of the invention are described with respect to the utilization of permanent magnets, it will be understood that the principles of the invention may be utilized to construct wire tensioning devices employing electric magnets. In such a construction suitable commutators are mounted on the shaft and coils are embedded in the discs and sheaves to set up steady magnetic fields that oppose each other.

Further, it is to be understood that the embodiments of the invention shown in FIGS. 1–4 may be modified to include strand tension sensing devices of the type shown in FIG. 5, which will effectuate the generation of control signals or appropriate movement of mechanical elements to provide automatic control of the movements of one or more of the magentic discs to regulate the tension imparted to the strand moving about the sheave.

What is claimed is:

1. A device for tensioning strand advancing between a supply reel and a utilization device, which comprises:

a shaft;

a sheave rotatably mounted on said shaft for receiving a wrap of strand, said sheave being magnetized to present opposite magnetic poles on opposite sides thereof;

a pair of discs movably mounted on said shaft with said sheave positioned therebetween, said discs being magnetized to present like magnetic poles to the magnetic poles of said sheave and to cause repelling magnetic fields therebetween; and means for moving at least one of said discs toward and away from said sheave to vary a drag effect resulting from the repelling magnetic fields between the discs and the sheave thereby adjusting the tension on said wrap of strand.

2. A device as set forth in claim 1 including a pair of stanchions for supporting said shaft, wherein said moving means comprises means moveable along said shaft to frictionally engage and hold one of said discs while the opposed magnetic fields between said discs and sheave act to force the other of said discs into frictional engagement with one of said stanchions.

3. A device as set forth in claim 1 wherein the disc moving means comprises:

means mounted on said shaft for moving one of said discs toward and away from the other disc to vary the intensity of the coupled magnetic fields.

4. A device as set forth in claim 1 wherein the disc moving means comprises:

a threaded section of said shaft; and a nut mounted on said threaded section.

5. A device as set forth in claim 1 wherein the disc moving means comprises:

a pair of spaced threaded sections on said shaft positioned on opposite sides of said sheave; and a pair of nuts mounted respectively on said pair of threaded sections.

6. A device as set forth in claim 1 wherein the disc moving means comprises:

a linear bearing mounted on said shaft;

a motor; and gearing interposed between said linear bearing and said motor for moving the linear bearing along said shaft to move one of said discs relative to the other disc and the sheave.

7. A device as set forth in claim 6 which comprises:

means for advancing the strand about the sheave to a utilization device;

means responsive to the tension in the strand for generating electrical signals indicative of the tension; and means responsive to said signals for controlling said motor to operate said gearing to move said linear bearing to vary the magnetic coupling between said discs and said sheave.

8. A device as set forth in claim 1 wherein said discs are internally threaded, and said shaft is provided with a pair of threaded sections of opposite hand to receive said discs, and wherein the disc moving means comprises:

guide means attached to said discs for holding said discs from rotation with said shaft while permitting said discs to be moved axially on said shaft toward and away from each other; and means for rotating said shaft to axially move said discs to vary the strength of the magnetic coupling between said discs and said sheave.

9. A device as set forth in claim 1 which comprises:

means for supporting and holding said shaft from rotation; and means for mounting at least one of said discs on said shaft for axial movement toward and away from said sheave.

10. A device as set forth in claim 1 including means for rotatably mounting said shaft, and wherein the disc moving means comprises:

means responsive to the rotation of said shaft for simultaneously moving said discs toward and away from said sheave;

means for holding said discs from rotation with said shaft; and means for rotating said shaft to simultaneously move said discs to vary the magnetic couplings between said discs and said sheave.

11. A strand tensioning apparatus, which comprises:

a shaft;

a sheave rotatably mounted on said shaft for engaging and imparting tension to an advancing strand, said sheave being constructed of magnetic material and being permanently magnetized to establish opposite magnetic poles on opposite sides thereof;

a pair of discs mounted on said shaft with said sheave positioned therebetween, said discs being constructed of paramagnetic material and being permanently magnetized to present like magnetic poles to the respective magnetic poles established on said sheave and to cause repelling magnetic fields therebetween; and means for moving at least one of said discs toward and away from said sheave to vary the intensity of the repelling magnetic fields between the sheave and the discs and accordingly varying the tension imparted to the advancing strand by said sheave.

12. An apparatus as defined in claim 11 which comprises:

a pair of spaced threaded sections of opposite hand formed on said shaft for engaging threaded apertures provided in said discs; and means for mounting said sheave on said shaft between said threaded sections for free rotation thereon, wherein the moving means includes means for turning said shaft to move said discs toward and away from said sheave to increase and decrease the effective magnetic repelling forces of the magnetic fields established about said discs and sheave while maintaining said sheave centrally located between said discs.

13. An apparatus as defined in claim 11 including a pair of spaced stanchions for supporting said shaft, and wherein the moving means comprises:

a threaded section formed on said shaft; and a member with a threaded central aperture mounted on said threaded section of said shaft for engaging and holding one of said discs to repel the magnetic field about the sheave against the magnetic field about the other disc and force said other disc into frictional engagement against an adjacent one of said stanchions.

14. An apparatus as defined in claim 11 including means sensing the tension in a strand advanced around said sheave for generating signals indicative of variations in the tension, and wherein the moving means comprises:

means slideably mounted on said shaft for moving a first of said discs toward and away from said sheave and a second of said discs; and means responsive to said generated signals for moving said slideably mounted means to move said first disc toward or away from said sheave and said second disc to maintain the tension in the advancing stand at a constant value.

15. A wire tensioning device which comprises:

a shaft;

a sheave rotatably mounted on said shaft for engaging an advancing wire, said sheave being constructed of magnetizable material and being axially magnetized to present opposite magnetic poles on opposite sides thereof;

a pair of discs mounted on said shaft to straddle said sheave, said discs being constructed of magnetizable material and being axially magnetized to present opposite magnetic poles on opposite sides of the respective discs, said discs being mounted on said shaft to present like magnetic poles to the magnetic poles on said sheave; and means for placing friction drag on said magnetic discs to impart a magnetic drag on said sheave and adjust the tension of said advancing wire.

16. A device for tensioning strand advancing between a supply reel and an utilization device, which comprises:

a shaft;

a pair of sheaves rotatably mounted on said shaft each sheave receiving a wrap of strand, said sheaves being magnetized to present opposite magnetic poles on respective opposite sides thereof and being positioned so that a first of said sheaves presents like magnetic poles to the magnetic poles of a second of said sheaves to cause repelling magnetic fields therebetween;

a pair of discs movably mounted on said shaft with said pair of sheaves positioned therebetween, a first of said discs being magnetized to present like magnetic poles to the first of said sheaves and a second of said discs being magnetized to present like magnetic poles to the second of said sheaves to cause repelling magnetic fields between respective sheaves and discs; and means for moving at least one of said discs toward and away from said sheaves to vary a drag effect resulting from the repelling fields between the pair of sheaves and between the respective discs and the sheaves thereby adjusting the tension on said respective wrap of strand.

17. A strand tensioning apparatus, which comprises:

a shaft;

a pair of sheaves rotatably mounted on said shaft for engaging and imparting tension to advancing strands, said sheaves being constructed of magnetic material and being permanently magnetized to establish opposite magnetic poles on respective opposite sides thereof, said sheaves being positioned so that a first of said sheaves presents like magnetic poles to the magnetic poles of a second of said sheaves to cause repelling magnetic fields therebetween;

a pair of discs mounted on said shaft with said pair of sheaves positioned therebetween, said discs being constructed of paramagnetic material, a first of said pair of discs being magnetized to present like magnetic poles to the magnetic poles established on said first of said sheaves and a second of said discs being magnetized to present like magnetic poles to the magnetic poles established on said second of said sheaves to cause repelling magnetic fields between said discs and said sheaves; and means for moving at least one of said discs toward and away from said sheaves to vary the intensity of the repelling magnetic fields between the sheaves and between the sheaves and the discs and accordingly varying the tension imparted to the respective advancing strands by the respective sheaves.

18. An apparatus as defined in claim 17 wherein the moving means comprises:

a pair of spaced threaded sections on said shaft for threadably mounting said discs with the rotatably mounted sheaves interposed between said discs on an unthreaded section of said shaft;

means for holding said discs from rotation with said shaft while permitting axial movement of said discs toward and away from each other along said shaft; and means for rotating said shaft to move said discs toward and away from said interposed sheaves to vary the intensity of the coupled portions of the respective magnetic fields established about said discs and sheaves.

* * * * *